US006062683A

United States Patent [19]

Kawakami et al.

[11] Patent Number: 6,062,683

[45] Date of Patent: May 16, 2000

[54] CONTAINER FOR SAFEKEEPING INK CARTRIDGE

[75] Inventors: Hideaki Kawakami; Tetsuo Suzuki, both of Yokohama; Junichi Asano, Kawasaki; Tsutomu Kawai, Yokohama; Shoji Kikuchi, Yokohama; Masahiro Taniguro, Yokohama; Hiroyuki Inoue, Yokohama; Hiroyuki Saito, Yokohama; Koichi Tanno, Kawasaki; Haruyuki Yanagi, Machida; Takashi Nojima, Tokyo; Makoto Kawarama, Ayase; Hiroyuki Kinoshita, Kawasaki; Masaya Shinmachi, Kawasaki; Tan At Ming, Kawasaki, all of Japan

[73] Assignee: Canon Kabushiki Kaisha, Tokyo, Japan

[21] Appl. No.: 08/901,559

[22] Filed: Jul. 28, 1997

Related U.S. Application Data

[63] Continuation of application No. 08/640,001, Apr. 30, 1996, which is a continuation of application No. 08/306,695, Sep. 15, 1994.

[30] Foreign Application Priority Data

| | | | |
|---|---|---|---|
| Sep. 22, 1993 | [JP] | Japan | 5-236318 |
| Oct. 22, 1993 | [JP] | Japan | 5-265052 |
| Aug. 24, 1994 | [JP] | Japan | 6-199509 |
| Aug. 29, 1994 | [JP] | Japan | 6-203752 |

[51] Int. Cl.[7] ..... B41J 2/175

[52] U.S. Cl. ..... 347/87

[58] Field of Search ..... 347/85–86, 108

[56] References Cited

U.S. PATENT DOCUMENTS

| | | | |
|---|---|---|---|
| 4,600,927 | 7/1986 | Sugitani | 347/87 |
| 5,231,416 | 7/1993 | Terasawa et al. | 347/23 |

FOREIGN PATENT DOCUMENTS

| | | | |
|---|---|---|---|
| 55-063750 | 5/1980 | Japan . | |
| 55-116215 | 8/1980 | Japan . | |
| 59-041588 | 3/1984 | Japan . | |
| 60-025844 | 2/1986 | Japan . | |
| 61-093265 | 6/1986 | Japan . | |
| 62-019460 | 1/1987 | Japan . | |
| 101964 | 4/1991 | Japan | 347/29 |
| 05254583 | 10/1993 | Japan . | |

*Primary Examiner*—N. Le
*Assistant Examiner*—Michael Nghiem
*Attorney, Agent, or Firm*—Fitzpatrick, Cella, Harper & Scinto

[57] ABSTRACT

A container for safekeeping an ink jet cartridge is provided with the main body of a container for storing an ink jet cartridge having a recording head unit, and an ink tank unit containing ink to be supplied to the recording head unit, a lid element for covering the inlet and outlet of the main body of the container for storing or removing the ink jet cartridge, an elastic cap member provided in the main body of the container for covering the recording head unit. This container for safekeeping an ink jet cartridge comprises a rib arranged on the inner wall surface of the lid element for exerting pressure on the recording head unit of the ink jet cartridge to press it to the elastic cap member; and a recess arranged on the inner wall surface of the main body of the container in a position corresponding to the location where the elastic cap member is arranged. In this way, it is possible to cap the recording head appropriately in the container to provide a highly reliable safekeeping of the ink jet cartridge, and at the same time, to store and safekeep the ink jet cartridges for monochromatic use and color uses exhangeably.

3 Claims, 9 Drawing Sheets

11
11a,11b
10
111
102

FIG.9A-1
FIG.9A
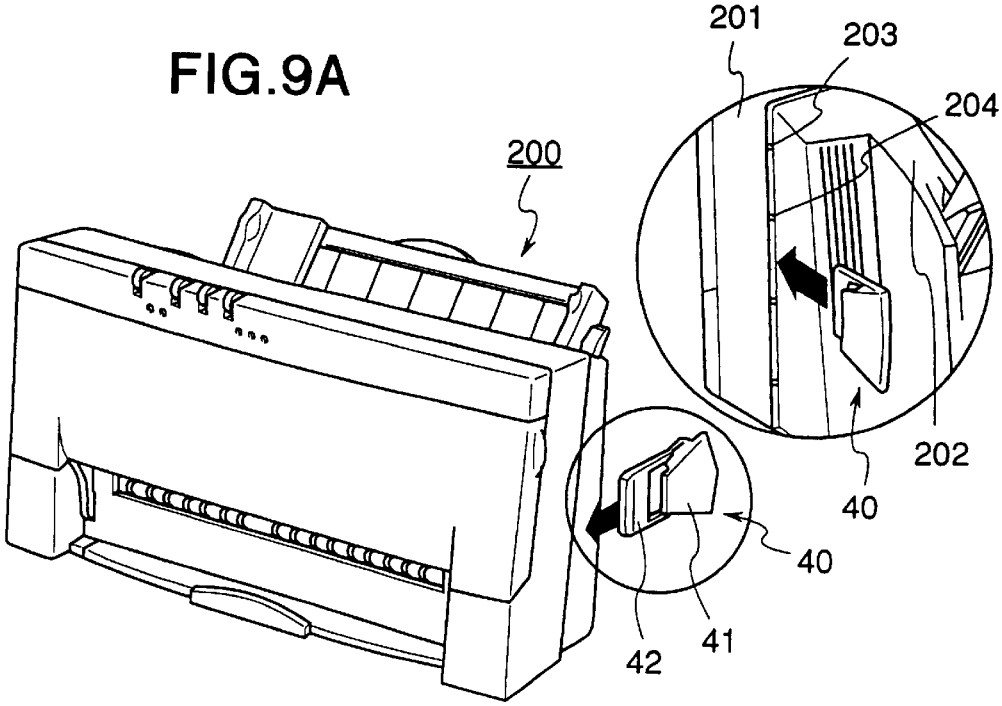
FIG.9B-1
FIG.9B
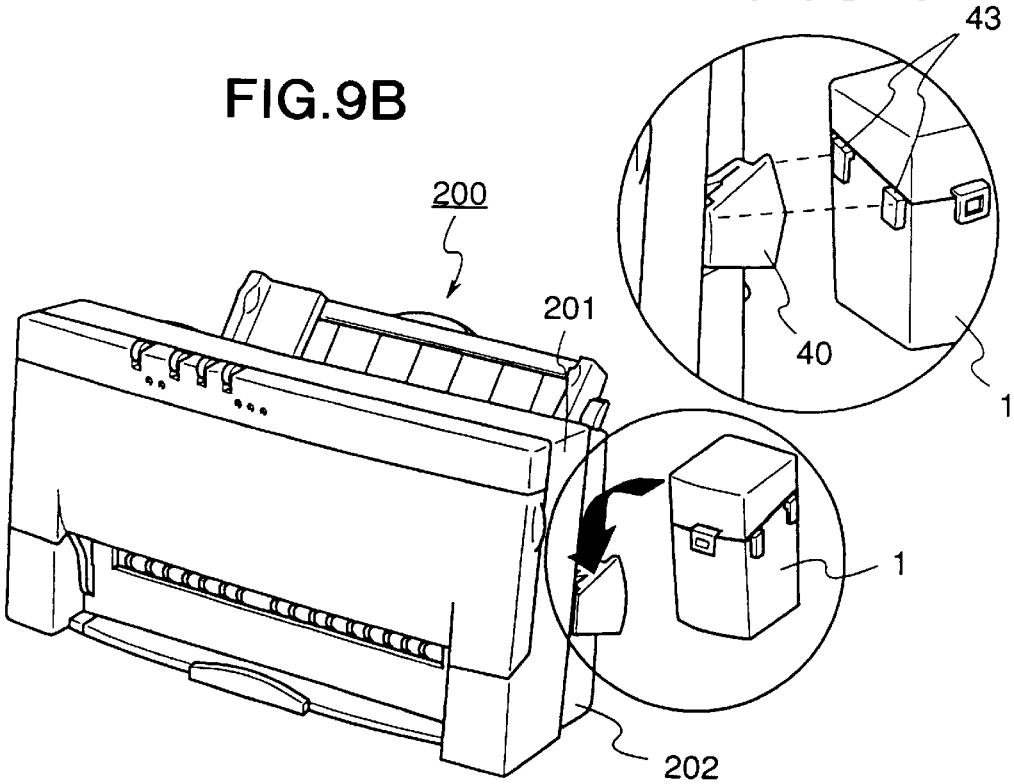

CONTAINER FOR SAFEKEEPING INK CARTRIDGE

This application is a continuation of application Ser. No. 08/640,001 filed Apr. 30, 1996, which is a continuation of application Ser. No. 08/306,695 filed Sep. 15, 1994.

BACKGROUND OF THE INVENTION

1. Field of the Invention

The present invention relates to a container for safekeeping an ink cartridge structured to be capable of being attached to or detached from a recording apparatus which can store and safekeep the ink cartridge in it. More particularly, the invention relates to a container having an improved structure for safekeeping the ink cartridge in order to provide an easy but highly reliable safekeeping condition thereof.

2. Related Background Art

As a mode of a recording apparatus of a type which uses ink for recording, there is an ink jet recording apparatus which discharges ink onto a recording medium as droplets adhering to it. In recent years, along with the increasing demand on small and inexpensive ink jet recording apparatuses, an apparatus has been proposed in which a recording head unit and an ink tank unit are mounted on a scanning carriage while supplying ink from the tank to the recording head, and an structure is arranged to make it possible for the operator to replace the units easily when ink in the tank is completely consumed, for instance.

Now, for the recording apparatus having the exchangeable means mounted on it for recording, a structure is proposed for storing and safekeeping the recording means in a container when preliminary means for recording or recording means is not in use. For example, in Japanese Utility Model Laid-Open Application No. 55-63750, a structure is disclosed, in which a spare ink cartridge is stored and safekept in the hollow core of a shaft for holding a rolled printing sheet. A structure is also proposed to provide storing and safekeeping conditions for an ink cartridge by arranging a unit dedicated to storing the ink cartridge on a part of the main body of the apparatus as disclosed in Japanese Laid-Open Application No. 61-93265. Further, in Japanese Laid-Open Application No. 55-116215 and Japanese Laid-Open Application No. 59-41588, a structure is disclosed, in which a container for storing an ink pen is held by a coupling device to the reverse side of the apparatus where it does not hinder the operation of the apparatus.

These containers are arranged to store the ink pen or ink cartridge in them and cover them closely or cap the pen directly in order to eliminate any drawback that may take place while in safekeeping, such as evaporation of ink.

Meanwhile, in Japanese Patent Laid-Open Application No. 5-254583, a structure is disclosed, in which a safekeeping box is arranged to safekeep an ink cartridge having a recording head unit and an ink tank unit integrally formed for it, and also, a cap covering the recording head unit, and a recovery pump connected to the cap are provided in the safekeeping box: the operation of the pump is interlocked with the opening and closing of the cover of the safekeeping box.

Now, in recent years, there has been proposed an ink jet recording apparatus arranged to use a color ink jet cartridge having different colors of ink in one ink tank, and an ink Jet cartridge having ink of single color (black, for instance), and to execute recording in colors or in monochrome by exchanging these cartridges as required.

In a recording mode such as this, it is conceivable among others that safekeeping containers are prepared for the respective ink jet cartridges in order to safekeep each one of them when it is not in use or a safekeeping container is prepared to provide double capacity for storing two ink jet cartridges individually in one safekeeping container. However, a problem is encountered in any one of these containers that the existence of plural containers hinders the operativity or the size of the safekeeping container becomes extremely large.

Also, the safekeeping container in which the recovery mechanism is incorporated as described above is apparently effective in holding different kinds of ink cartridges in one safekeeping container, but there is a possibility that the circumference of the cap is stained by ink which is exhausted by the recovery operation, thus contaminating the discharge port surface of the other ink cartridge.

Further, there is a need for securing an extra space for arranging the ink jet cartridge which is comparatively large as compared to the pen if it is safekept in a container to be coupled to the reverse side of the apparatus. This is one problem to be solved. In addition, not only there is required a member dedicated to mounting the safekeeping container, but also its handling is not convenient because it is mounted on the back of the recording apparatus.

SUMMARY OF THE INVENTION

The present invention is designed to solve these problems. It is an object of the invention to provide a safekeeping container capable of safely and reliably storing the ink cartridge which discharges different kinds of ink, while arranging its structure more simply.

In order to achieve the above-mentioned object, the inventor hereof et al. have studied existing problems and carried out experiments. As a result, it is found that an excellent capping condition can be obtained by utilizing elasticity of an elastic cap member even for different kinds of ink jet cartridges, and that the bending of the elastic cap member can be fully utilized by providing a recess on the inner wall surface of the container where the elastic cap member is provided. Moreover, a knowledge is obtained that the reliable capping condition can be implemented by adopting a structure whereby to exert pressure in the direction in which the recording head abuts upon the cap member.

In accordance with the above-mentioned finding and knowledge, the safekeeping container of the present invention comprises the main body of the container for safekeeping the ink jet cartridge having the recording head unit, and the ink tank unit which is filled with ink to be supplied to the recording head unit; a lid member for covering the inlet and outlet of the main body of the container, which are provided for storing or removing the ink jet cartridge; and an elastic cap member arranged in the main body of the container for covering the recording head unit of the cartridge. In this container, a rib is arranged on the inner wall surface of the lid member for exerting pressure to the recording head unit of the ink jet cartridge so that it is pressed to the elastic cap member. At the same time, a recess is arranged on the inner wall surface of the main body of the container in the corresponding position where the elastic cap member is installed.

In the present invention, the elastic cap member is provided with an elastic rib which is in contact with the circumference of the surface of the discharge ports for discharging ink from the recording head unit. Here, cut-off portions are partly provided for the elastic rib.

Also, in the main body of the container, a rib is arranged for guiding the ink jet cartridge in order to regulate the condition in which it abuts upon the elastic cap member of the recording head in the container.

Further, the ink jet cartridge is either in a mode where the recording head unit and ink tank unit are integrally formed or in a mode where the recording head unit and ink tank unit can be attached together or detached apart. The container for safekeeping the ink jet cartridge is capable of storing the ink jet cartridge exchangeably in either modes. At least in a case of the ink jet cartridge having the mode where the recording head unit and ink tank unit are arranged to be attached together or detached apart, the aforesaid rib presses a frame which guides the ink tank unit.

In addition, a coupling element is arranged on the side end of the main body of the container to make it possible to coupled it with the side end of the recording apparatus which uses the ink cartridge.

Further, the main body of the apparatus is structured by a first housing and a second housing which are connected to form the outer housing. The aforesaid coupling element of the container is arranged to engage with the connection between the first and second housings.

Also, the coupling element is divided into two parts, while the first and second housings of the apparatus are provided with a plurality of reinforcing ribs on the connection therebetween. The coupling element of the container engages with such connection between the two housing while having the reinforcing ribs between the divided parts of the coupling element.

With the arrangement of the recess on the inner wall surface of the main body of the container with respect to the elastic cap member, it is possible to avoid collapsing the cap excessively when the recording head is pressed to condition the capping status. In this way, any overload to the surface of the discharge ports of the recording head can be prevented, hence exercising a good protection of the head.

Also, the provision of the rib on the lid member of the safekeeping container, which presses the ink jet cartridge to the cap makes it possible to provide a perfect capping condition just by closing the lid member. Therefore, any unwanted pressure is exerted on the ink jet cartridge and the recording head unit, thus securing the reliability of the safekeeping condition.

The cut-off portions are partly provided for the elastic cap in order to allow the air in the cap to escape when the ink jet cartridge is stored in the container and, in turn, the recording head abuts upon the cap. There is then no possibility that the meniscus of ink formed on the discharge ports are broken.

Also, the rib arranged in the main body of the safekeeping container can regulate the abutting condition between the guide and cap when the ink jet cartridge is stored. Therefore, it is possible to secure the safekeeping condition reliably and stably.

Further, the ink jet cartridge to be stored in the safekeeping container can be both in a mode where the recording head and ink tank are integrally formed and in a mode where these units are exchangeable. As a result, the operativity of the container is enhanced. Also, the ink jet cartridge having the exchangeable recording head and ink tank is provided with a frame keeping the recording head, and at the same time, guiding the ink tank. Here, the arrangement is made to allow the rib of the container to press this frame. As a result, a pressure acts upon the recording head reliably.

On the side end of the safekeeping container, there is arranged the coupling element which divided into two parts, whereby the container is attached to the side end of the recording apparatus. Therefore, the operativity of the safekeeping container is good when storing the ink jet cartridge into or removing it from the container. Also, while the safekeeping container is arranged to be attached to the housing arranged from the back to the front for the formation of the recording apparatus, it is possible to store the ink jet cartridge into or remove it from the container vertically. Therefore, the good operativity of the ink jet cartridge can be obtained without being affected by the condition in which the safekeeping container is attached to the apparatus.

Also, a gap is provided in the connection between two housing which are coupled to constitute the recording apparatus. This gap is utilized for attaching the safekeeping container. At the same time, by use of the coupling element provided for the safekeeping container, which is divided into two parts, the safekeeping container pinches the reinforced rib arranged on the connection between two housings when it is attached thereto. Therefore, there is no possibility that the safekeeping container becomes unstable in the vertical direction, thus implementing a reliable installation thereof.

BRIEF DESCRIPTION OF THE DRAWINGS

FIG. 1A is a front view. FIG. 1B is a side view showing the left side of the container. FIG. 1C is a side view showing the right side thereof. FIG. 1D is a top view thereof.

FIG. 2A is a top view in a state that the lid member of the safekeeping container is open. FIG. 2B is a cross-sectional view taken along line A—A in FIG. 2A.

FIG. 3A is a schematic front view of the elastic element. FIG. 3B is a partially enlarged cross-sectional view showing the condition in which the elastic element is mounted to the safekeeping container.

FIG. 4A is a top view. FIG. 4B is a front view. FIG. 4C is a bottom view.

FIG. 5A is a top view. FIG. 5B is a front view. FIG. 5C is a bottom view.

FIG. 8A is an enlargement perspectively showing the part of a recording apparatus where the safekeeping container is mounted. FIG. 8B is a perspective view showing the state of the safekeeping container being coupled to the recording apparatus. FIG. 8C is a perspective view showing the state where the safekeeping container is coupled to the recording apparatus.

FIGS. 9A and 9B are views illustrating another example in which a safekeeping container is mounted on a recording apparatus. FIG. 9A is a perspective view showing the mounting condition of an elastic arm. FIG. 9A-1 is an enlarged view showing an elastic arm which mounts to a side of a recording apparatus where the safekeeping container is mounted. FIG. 9B is a perspective view showing the state where the safekeeping container is mounted on the elastic arm. FIG. 9B-1 is an enlarged view showing the part of the recording apparatus where the safekeeping container is mounted.

DETAILED DESCRIPTION OF THE PREFERRED EMBODIMENTS

Hereinafter, with reference to the accompanying drawings, the description will be made of the embodiments according to the present invention.

Figure 1C:
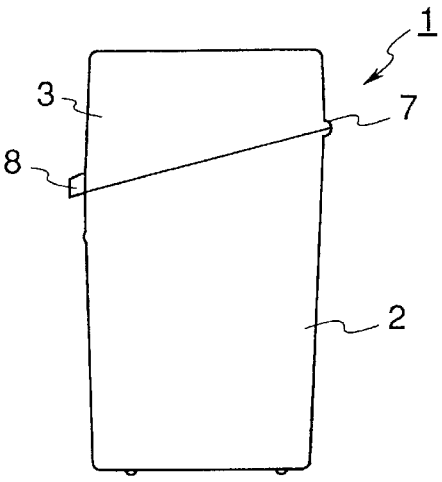
FIGS. 1A to 1D are views illustrating the structure of a safekeeping container to which the present invention is applicable.
Figure 1A:
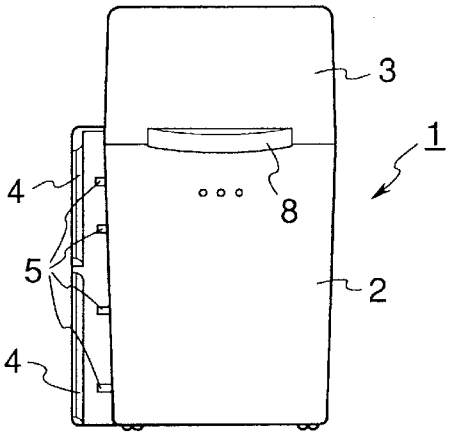
Figure 1D:
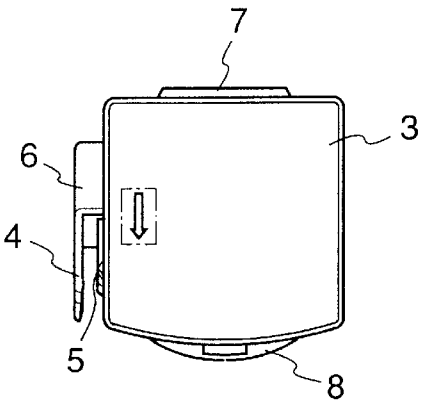
Figure 1B:
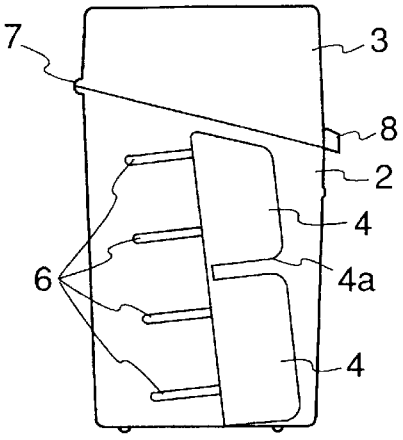

FIGS. 1A to 1D are views schematically showing a safekeeping container 1 according to the present invention for housing and safekeeping an ink jet cartridge in it. FIG. 1A is the front view, FIG. 1B is the left side view, FIG. 1C is the right side view, and FIG. 1D is the top view of the safekeeping container, respectively.

The safekeeping container 1 comprises the main body 2 of the container for housing an ink jet cartridge, and a lid member 3 for covering the aperture for-safekeeping the ink jet cartridge into or removing it from the main body 2 of the container. The main body 2 of the container and the lid member 3 are integrally mounted by means of a hinge section 7 to make the lid member 3 rotative. Also, the main body 2 of the container and the lid member 3 are closed by the engagement of a snap (a structure to allow the engagement between a coupling element 8 and an element 9 (not shown) to be coupled) arranged on the front end of the safekeeping container 1.

On the left side end of the main body 2 of the container, an elastic arm 4 for installation is arranged for mounting the safekeeping container on the main body of a recording apparatus. As clear from FIG. 1B, the elastic arm 4 for installation is arranged to provided a structure which is divided into two parts. This structure will be described later in detail, but it is mounted in such a manner that the reinforcing rib which is provided for the mounting portion of the main body of the recording apparatus is positioned in the divided portion 4*a* of the elastic arm 4 for installation. Also, being divided, the elastic arm 4 for installation is capable of coupling more reliably with the main body of the recording apparatus elastically to keep the mounting condition. The elastic arm 4 for installation is not necessarily confined to the mode of the present invention as a matter of course. It may be possible to adopt a structure formed by a single flat board. Further, it is of course possible to adopt a structure having plural divisions.

Figure 2A:
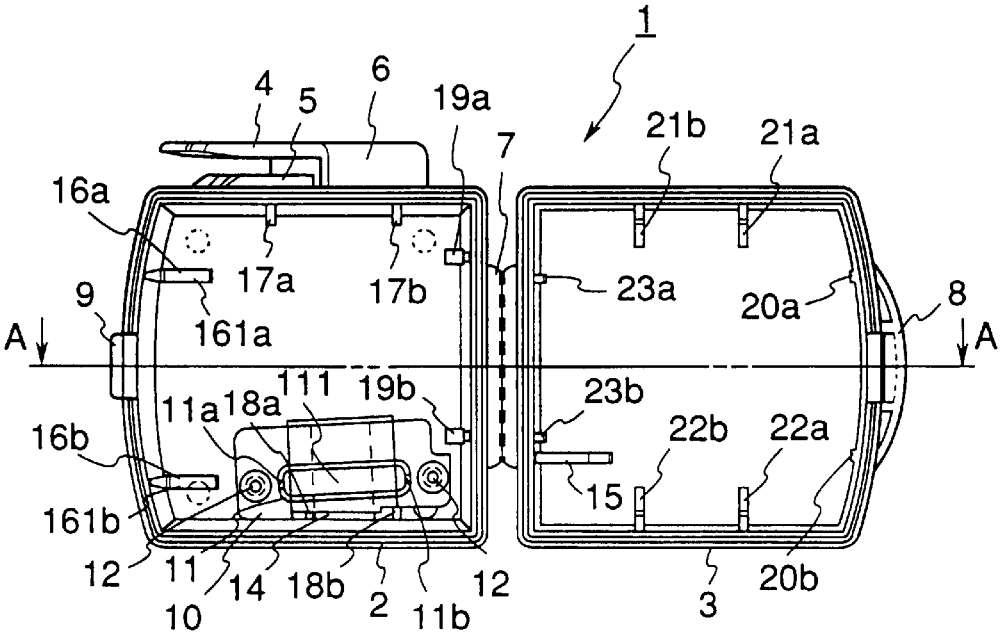
FIGS. 2A and 2B are views illustrating the inner structure of the safekeeping container to which the present invention is applicable.
Figure 2B:
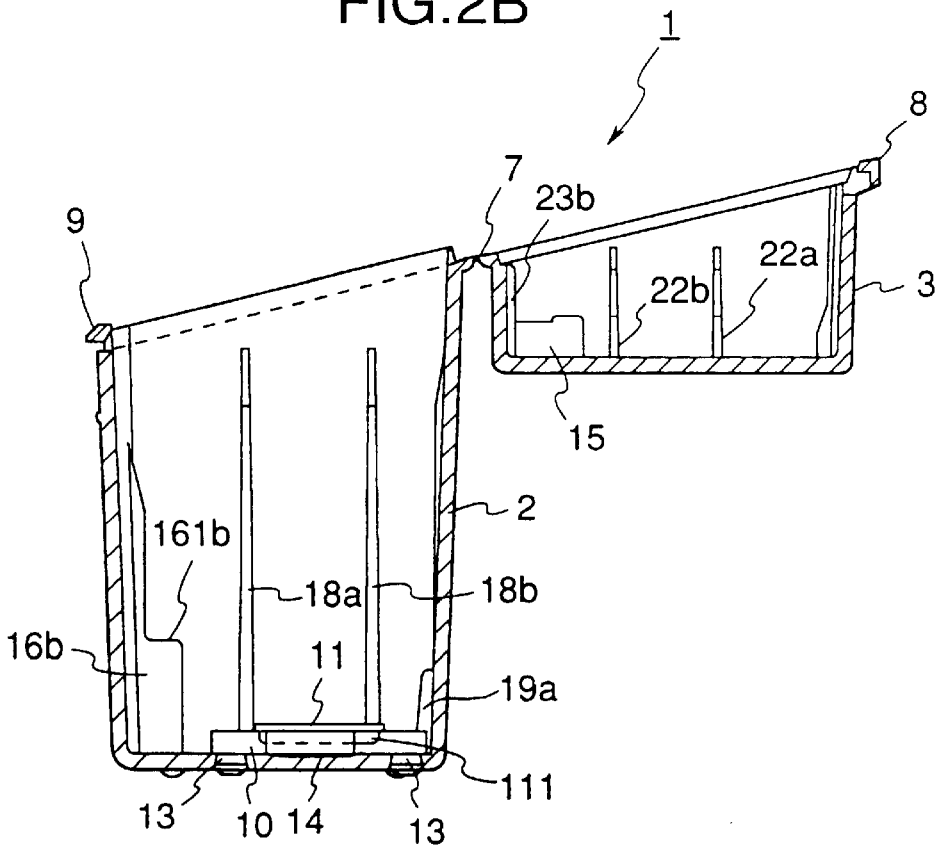

In the gap between the elastic arm 4 for installation and the main body 2 of the container, a plurality of inner ribs 5 are provided, and also, behind the elastic arm 4 for installation, a plurality of outer ribs 6 are continuously provided. By means of the inner ribs 5 and the elastic arm 4 for installation, the housing of the main body of the recording apparatus is pinched in reliably, and further, by means of the outer ribs 6, the back of the safekeeping container is caused to be set along the outer side of the housing of the main body of the apparatus. Thus it is possible to mount the safekeeping container on the side end of the recording apparatus stably. FIGS. 2A and 2B are views schematically showing the inner structure of the safekeeping container 1. FIG. 2A is a view showing the inner structure of the main body 2 of the container and the lid member 3 when the lid member 3 is open. FIG. 2B is a cross-sectional view taken along line A—A in FIG. 2A.

On each of the four inner wall surfaces of the main body 2 of the safekeeping container 1, two ribs 16*a* and 16*b*, 17*a* and 17*b*, 18*a* and 18*b*, and 19*a* and 19*b* are respectively arranged substantially along the outer contour of the ink jet cartridge to be stored as shown in FIG. 2A. At the same time, an elastic element 10 is arranged on the bottom end of the container, which constitutes an elastic cap abutting upon the surface of the discharge ports of the recording head of the ink jet cartridge and covers the discharge ports. By means of the ribs 16, 17, 18, and 19 arranged on the inner wall surfaces, the ink jet cartridge is stored in a given condition without any errors.

Here, the ribs 16*a* and 16*b* are those arranged on the front side of the main body of the container, and as shown in FIG. 2B, a large difference 161*b* in level (difference 161*a* is also configured in the same manner) is provided for each of them on its midway. These differences in level 161 abut on a part of the ink jet cartridge which will be described later, and regulate the ingression of the ink jet cartridge to optimize the capping condition of the recording head unit.

Figure 3A:
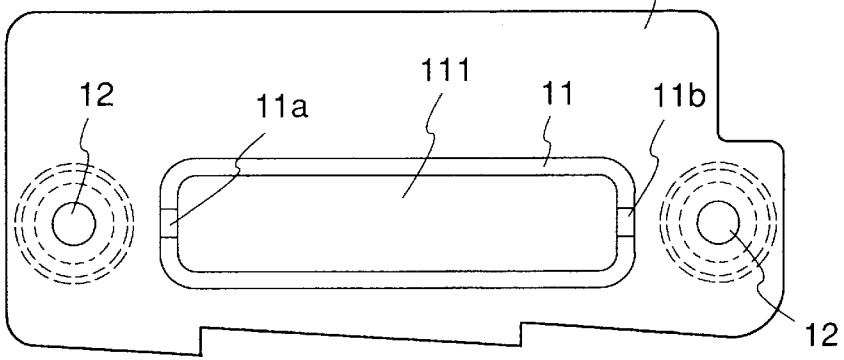
FIGS. 3A and 3B are views illustrating the mounting condition of an elastic element.
Figure 3B:
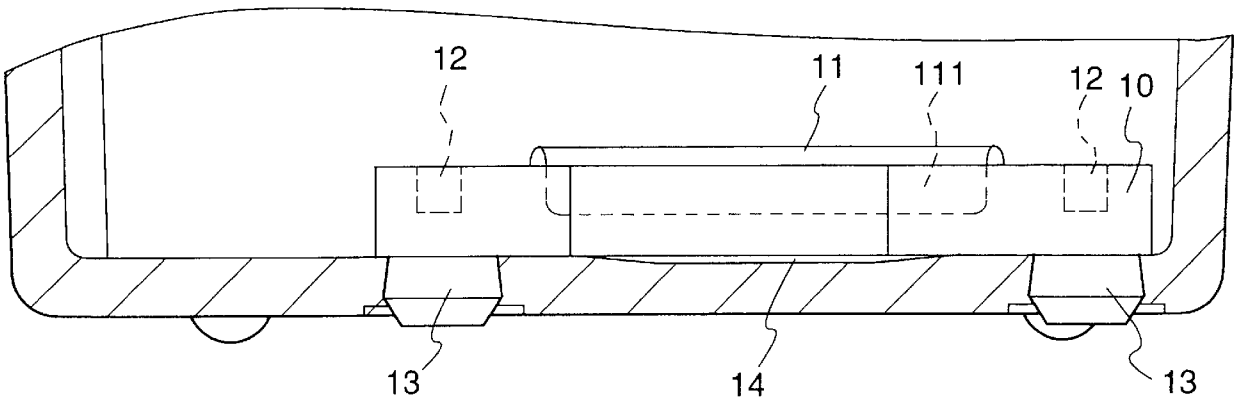

FIGS. 3A and 3B are enlargements of the structure in the vicinity of the elastic element 10. The elastic element 10 is made of chrolinated butyl rubber and others having a hardness of approximately 30°. As shown in FIG. 3A, an elastic rib 11 is arranged. This rib abuts on the area corresponding to the surface of discharge ports of the recording head of the inserted ink jet cartridge, and forms the capping condition. This elastic rib 11 is made in a rectangle having a height of 0.5 to 2.0 mm surrounding the discharge ports so that it does not touch them directly. On the shorter edges of the rectangular rib 11, cut-off portions 11*a* and 11*b* each having a width of 0.5 to 2.0 mm and a depth of 0.1 to 0.5 mm are provided. These cut-off portions 11*a* and 11*b* are arranged to prevent defective printing from taking place due to the condition where no ink exist in the discharge ports of the recording head. When the ink jet cartridge is stored, the recording head abuts upon the elastic rib 11. Then if any sealing is airtightly effectuated immediately, the air in the space created by the recess 111 provided for the formation of the cap is not allowed to escape. Consequently, pressure is exerted on the discharge ports directly so that the ink meniscus formed on the section of the discharge ports is pressed backward, hence creating the condition where no ink exist in the discharge ports of the recording head.

On the back of the elastic element 10, two bosses 13 are arranged for its installation to the main body 2 of the container. When installing the element, these bosses 13 are inserted into the mounting holes provided correspondingly for the main body of the container. Each of the bosses 13 are tapered invertedly as shown in FIG. 3B to make them difficult to be removed. Also, in the corresponding positions on the surface opposite to the bosses, marked holes 12 are arranged. Therefore, when assembling, the bosses can be smoothly inserted into the mounting holes just by pressing the positions where the marked holes are provided.

In this respect, on the bottom of the main body of the container substantially facing the cap portion of the elastic element 10, a slight recess 14 is arranged. The recess 14 is 0.1 to 0.5 mm deep. This recess is provided for the purpose of optimizing the abutting condition of the recording head and the elastic rib 11. Due to the tolerances of the contour dimension of the ink jet cartridge, and the dimension of the differences in level of the inner ribs 16 formed in the main body of the container, there is a possibility that the elastic rib 11 is collapsed too much. The provision of the recess makes it possible for the elastic element 10 to escape to the recess 14 side, whereby to avoid the excessive collapse of the elastic element, and then, for the protection of the recording head, any unnecessarily great load is prevented from being applied to the surface of the discharge ports.

Meanwhile, in the lid member 3, inner ribs 20*a*, 20*b*, 21*a*, 21*b*, 22*a*, 22*b*, 23*a*, and 23*b* are arranged as shown in FIGS. 2A and 2B. At the same time, a pressure rib 15 is provided for abutting upon a part of ink tank side facing the recording head unit of the stored ink jet cartridge. Of these ribs, the pressure rib 15, inner ribs 21 and 22 are provided with differences in level, and then, the structure is arranged to press the upper edge of the ink jet cartridge stored in the container by means of the respective differences in level. With the pressure exerted on the ink jet cartridge from the above, it is possible to obtain a good abutting condition of the elastic rib 11 on the recording head. Particularly, since the pressure rib 15 is provided so that the area facing the recording head is pressed, it is possible to obtain the abutting condition of the recording head on the elastic rib 11 reliably.

Here, in conjunction with FIGS. 4A to 4C and FIGS. 5A to 5C, the description will be made briefly of the structure of an ink jet cartridge which can be stored in the safekeeping container of the present invention.

Figure 4A:
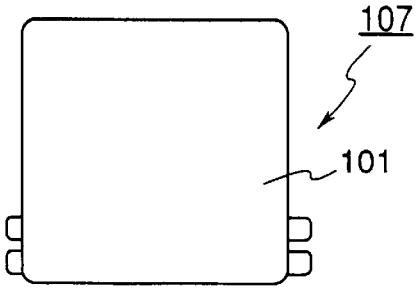
FIGS. 4A to 4C are views schematically illustrating a monochromatic ink jet cartridge.
Figure 4B:
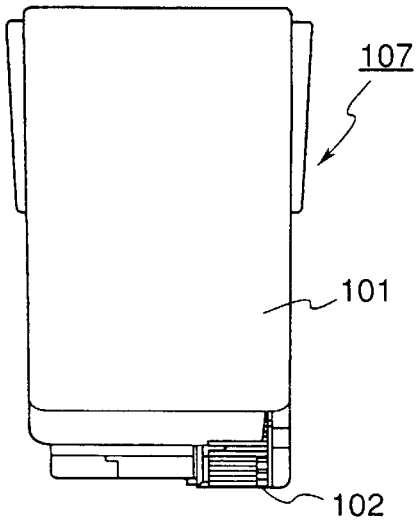
Figure 4C:
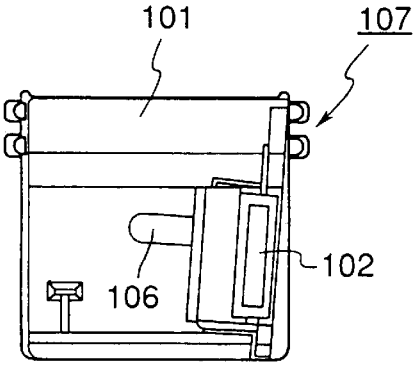

FIGS. 4A, 4B, and 4C are a top view, side view, and bottom view of an ink jet cartridge, respectively, in which a monochromatic ink jet cartridge 107 is represented where only black ink is contained in the ink tank 101, while a recording head unit 102 and an ink tank 101 are integrally formed. Ink is supplied from the ink tank 101 to the recording head 102 by means of ink supply path 106.

Figure 5A:
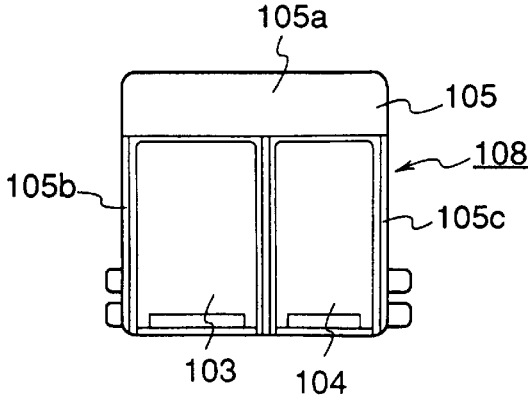
FIGS. 5A to 5C are views schematically illustrating a color ink jet cartridge.
Figure 5B:
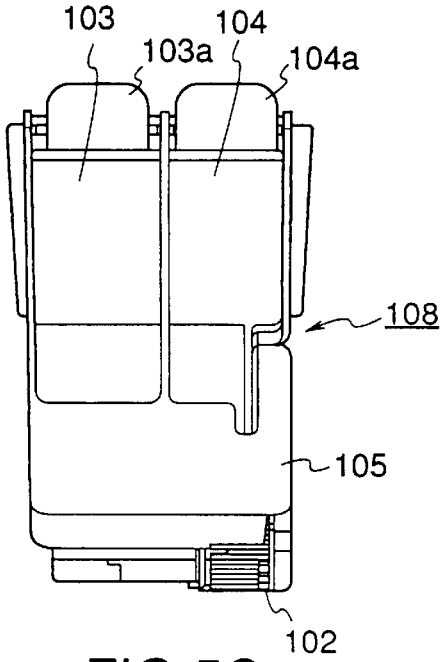
Figure 5C:
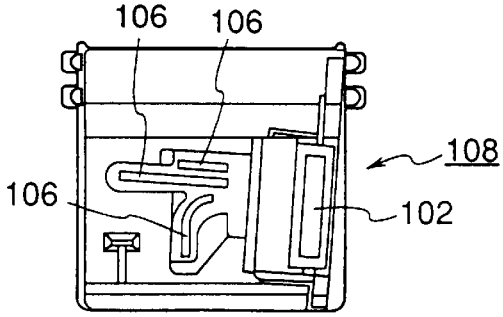

On the other hand, FIGS. 5A, 5B, and 5C are a top view, side view, and bottom view of an ink jet cartridge, respectively. The ink jet cartridge shown in FIGS. 5A to 5C is structured to make the ink tank attachable to or detachable from the recording head. A reference numeral 103 designates a color ink tank containing in it each color ink of yellow, cyan, and magenta integrally, and 104, an ink tank containing it black ink. These ink tanks 103 and 104 are arranged to be attached to or detached from a frame 105 whereby the recording head 102 is installed. Ink is supplied from the ink tanks 103 and 104 to the recording head 102 through ink supply paths 106.

Now, with conjunction with FIGS. 6A to 6D, the description will be made of the capping condition which is created by the elastic rib 11 of the elastic element 10 and the recording head 102 when the ink jet head cartridge 107 or 108 is stored in the safekeeping container 1.

Figures 6A, 6B, 6C, 6D:
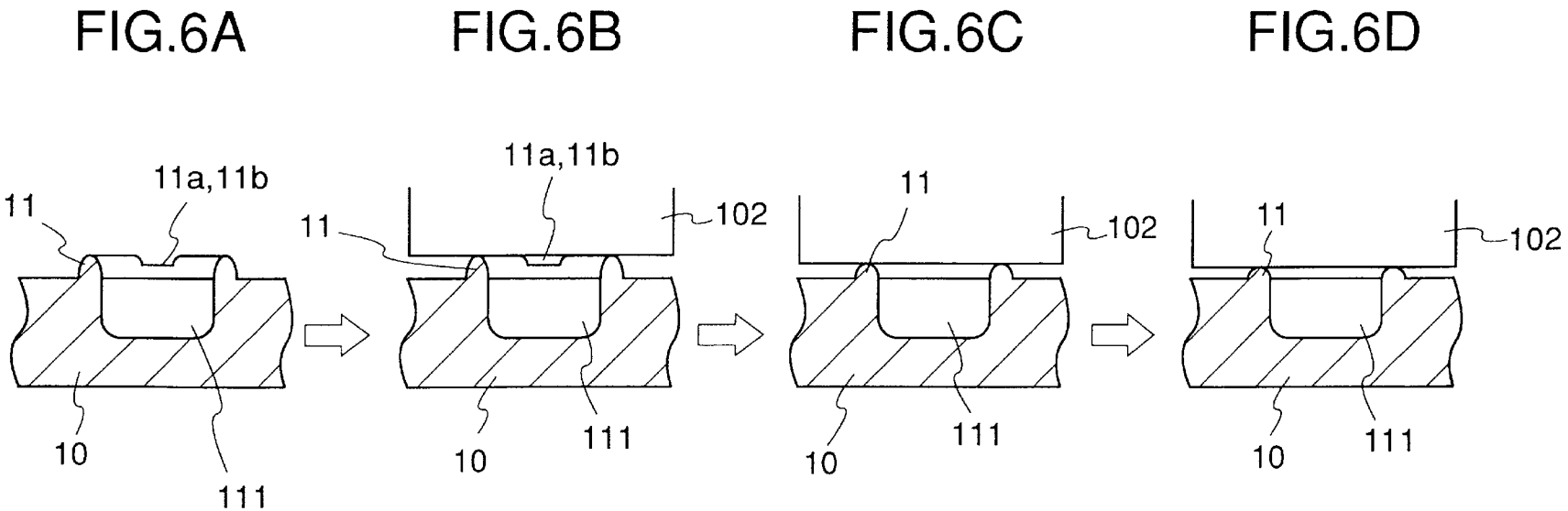
FIGS. 6A to 6D are enlargements of the vicinity of the elastic element, whereby to illustrate in order the states where an ink jet cartridge is being stored in the safekeeping container.

At first, the recording head 102 shown in FIG. 6B approaches the elastic element 10 arranged in the safekeeping container 1 as shown in FIG. 6A, and abuts upon the elastic rib 11 of the elastic element 10. At this juncture, the ingression of the ink jet cartridge is regulated by the inner ribs 16, 17, 18 and 19 provided in the main body 2 of the container. Hence there is no possibility that the elastic rib 11 is pressed excessively. Consequently, in this state, the cut-off portions 11*a* and 11*b* arranged on the shorter edges of the elastic rib 11 are not collapsed, and the recess 111 constituting the cap and the outside are still communicated. The discharge ports of the recording head is not pressed. In continuation, as the lid member 3 of the safekeeping container 1 is being closed, the ink jet cartridge is pressed by the inner ribs 21 and 22 arranged on the inner surface of the lid member 3, the cut-off portions 11*a* and 11*b* arranged on the shorter edges of the elastic rib 11 disappear as shown in FIG. 6C. Then, when the lid member 3 is closed and coupled to the main body 2 of the container by means of snap, the elastic rib 11 is pressed slightly further by 0.2 to 1.0 mm as shown in FIG. 6D, hence safekeeping the ink jet cartridge completely. The collapsing amount of the elastic rib 11 is controlled by the dimension from the leading end of the recording head 102 of the ink jet cartridge to the ink tank 101 or to the bottom of the frame 105, the dimension of the difference in level 161 of the inner ribs 16, the dimension of the elastic element 10 and elastic rib, and the dimension of the recess 14.

As described above, when the ink jet cartridge is dropped in the safekeeping container having the structure according to the present invention, the ingression of the ink jet cartridge is suspended once in a state that the recording head 102 abuts upon the elastic rib 11 by the action of the inner ribs 16, 17, 18, and 19 in the main body of the container. Consequently, the cut-off portions 11*a* and 11*b* can stay as they are. There is no possibility that the ink meniscus on the discharge ports is caused to recede, and then, the recording head gradually collapses the elastic rib 11 as the lid member 3 is being closed. In this way, no shock is given to the discharge ports: a good condition of safekeeping condition is obtainable.

Figure 7:
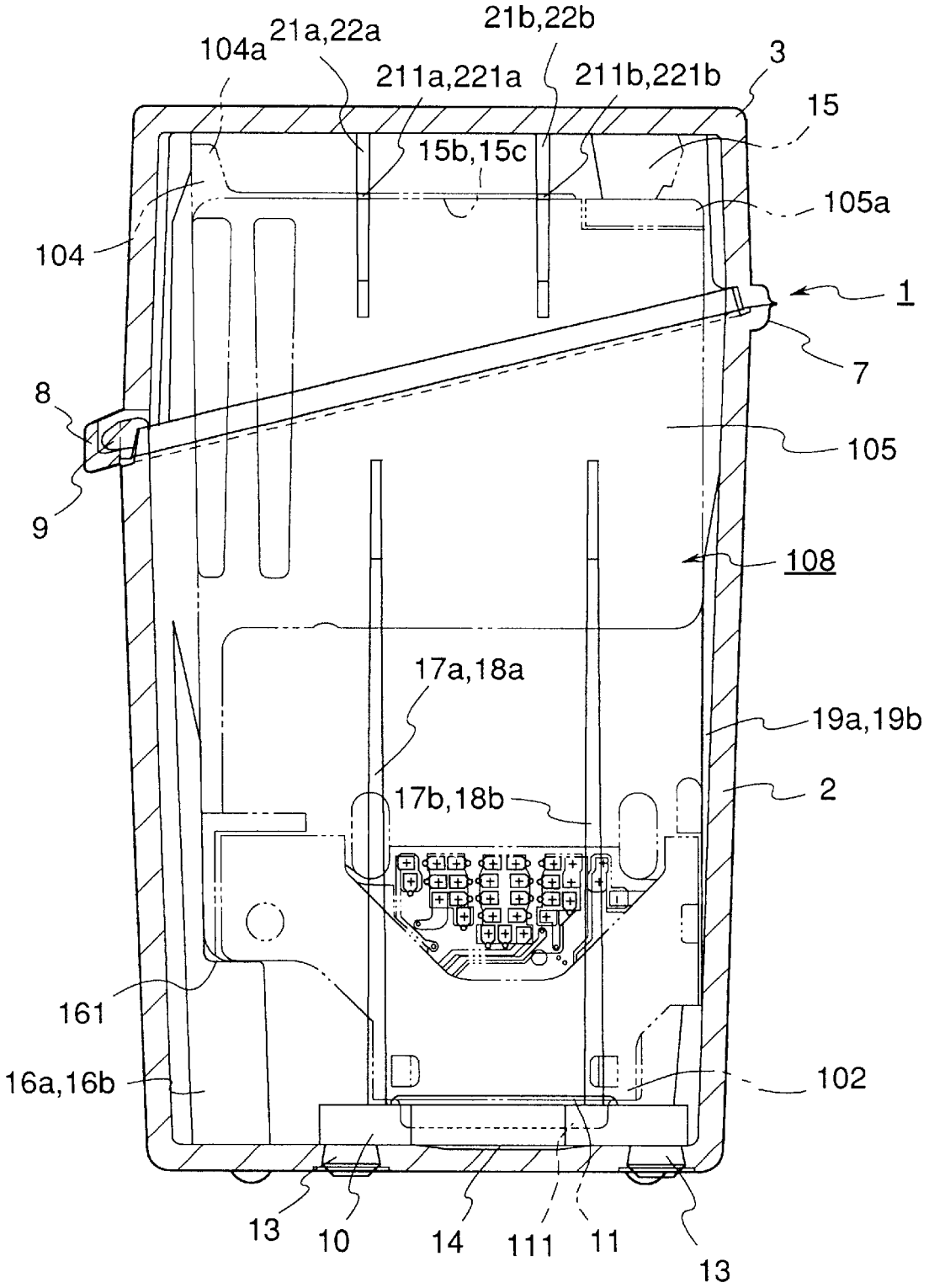
FIG. 7 is a cross-sectional view illustrating a state where an ink jet cartridge is stored in the safekeeping container.

FIG. 7 is a view showing the state where an ink jet cartridge 108 for color recording is stored in the safekeeping container, in which the ink jet cartridge 108 is represented by imaginary line.

As clear from FIG. 7, the mounting condition of the ink jet cartridge 108 is made by use of the inner rib 15 which presses the frame 105*a*, while the frames 105*b* and 105*c* being pressed by the differences in level 211*a*, 211*b*, 221*a*, and 221*b* of the inner ribs 21*a*, 21*b*, 22*a*, and 22*b*.

When the exchangeable ink tanks 103 and 104 are adopted as in this case, it is impossible to create any acting force whereby to press the surface of discharge ports of the recording head to the elastic rib 11 of the elastic member 10 in a desirable condition if only the ink tanks 103 and 104 are arranged to be pressed because this simply creates the state where the ink tanks 103 and 104 are pressed to the recording head 102. In contrast, if the frame 105 where the recording head is provided is pressed directly as shown in FIG. 7, the pressure is exerted directly on the recording head 102, hence making it possible to obtain a good and reliable capping condition.

In this respect, the ink tanks 103 and 104 for the ink jet cartridge 108 for color recording are provided with knobs 103*a* and 104*b* for easier attachment or detachment. Therefore, the lid member 3 cannot be closed unless the ink jet cartridge is installed in the regular position.

Also, the ink jet cartridges 107 and 108 for monochromatic recording and color recording are of the same appearance substantially. Therefore, these cartridges can be stored exchangeable in the container without a hitch.

Further, in operating the safekeeping and safekeeping condition of the ink jet cartridge, the capping condition of the recording head is obtained in two stages. Thus there is no possibility that any unnecessary shock is given to the discharge ports, making it difficult to allow ink to be spread. As a result, even when the ink jet cartridges 107 and 108 for monochromatic recording and color recording are exchangeable stored, the elastic element 10, elastic rib 11, or recess 111 is scarcely stained by ink, thus the problem of color mixing can rarely take place. Also, the elastic rib 11 is arranged to abut upon the circumference which is apart from the discharge ports by a given distance for the precaution against any possible color mixing.

When the ink jet cartridge is removed from the safekeeping container 1, the pressure from the above is released by opening the lid member 3. Then the ink jet cartridge is pushed up slightly by the restoring force of the elastic rib 11. The cut-off portions 11*a* and 11*b* of the elastic rib 11 appear and make it possible for the recess 111 to communicate with the outside. Therefore, no load is applied to the discharge ports of the recording head when the ink jet cartridge is removed from the safekeeping container. Also, it is drawn from the container without causing ink to spread. This is one of the advantages, which enables the exchangeable safekeeping condition of ink jet cartridges 107 and 108 for monochromatic recording and color recording.

In this respect, a recovery operation is executed before the ink jet cartridge is removed from the recording apparatus in order to keep the surface of discharge ports clean. This can be one of advantages which makes it possible for the safekeeping container to keep the ink jet cartridges for color use and monochromatic use exchangeably in safekeeping condition.

In this respect, it is also arranged for the safekeeping container 1 to prevent any errors from taking place in safekeeping the ink jet cartridge 107 or 108 by utilizing the relationship between the outer appearances of these cartridges and the inner ribs of the safekeeping container.

The safekeeping container 1 which is arranged such as this can be attached to a recording apparatus. Its state is shown in FIGS. 8A and 8B.

Figure 10:
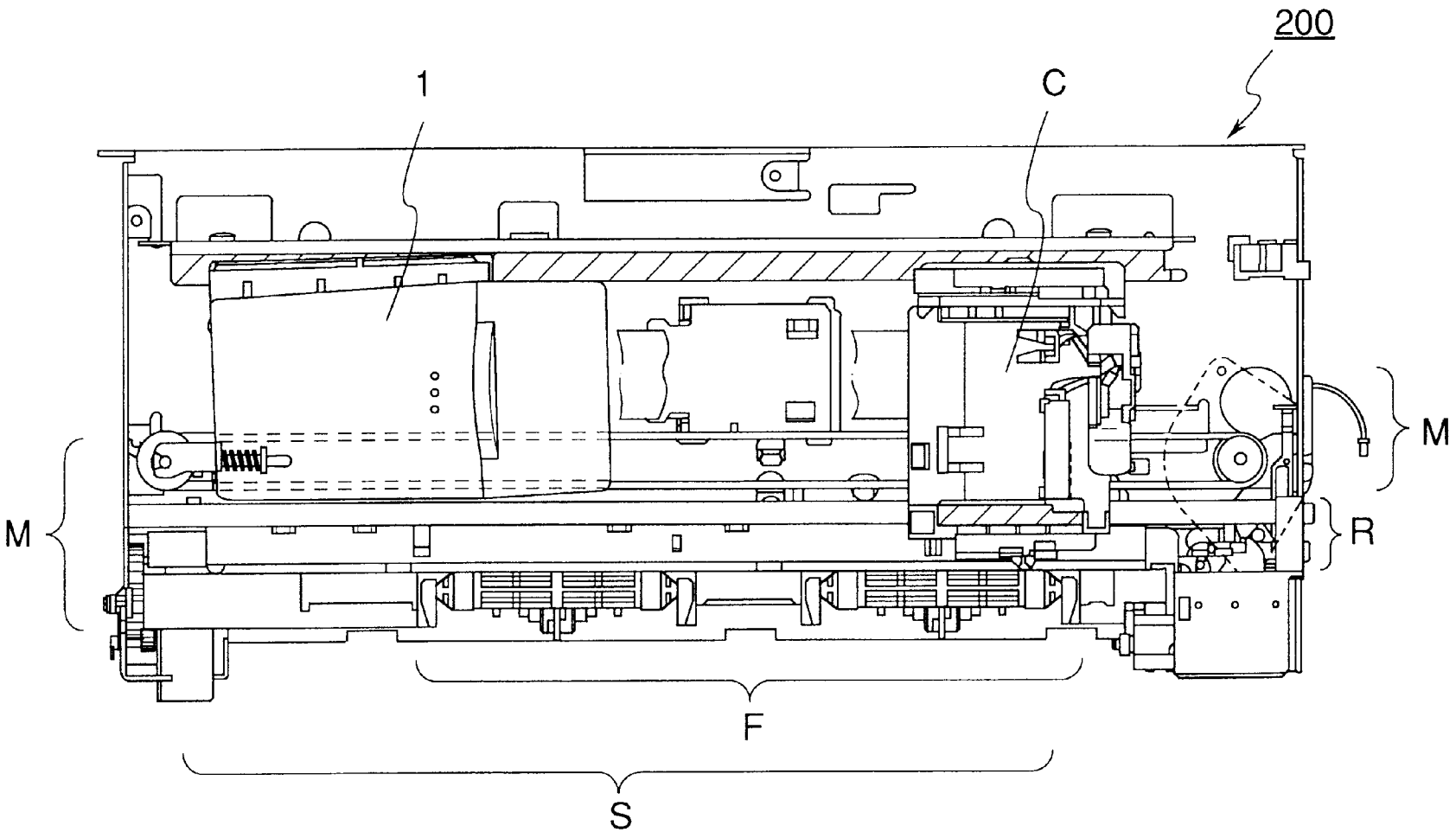
FIG. 10 is a view schematically showing the state where a safekeeping container is housed in a space provided in a recording apparatus for a carriage to scan.

The recording apparatus 200 is formed by coupling a front cover 201 and a rear cover 202, and an ink jet cartridge is exchangeably installed in its interior as shown in FIG. 10. Also, there are incorporated among others a carriage C which scans between a recording area and a recovery position, a device R for recovering the condition of discharge of the recording head of the ink jet cartridge, means F for feeding means a recording medium on which a recording is performed, means M for driving these constituents, and a controller (not shown) for controlling the operation of the constituents and means.

Figure 8A:
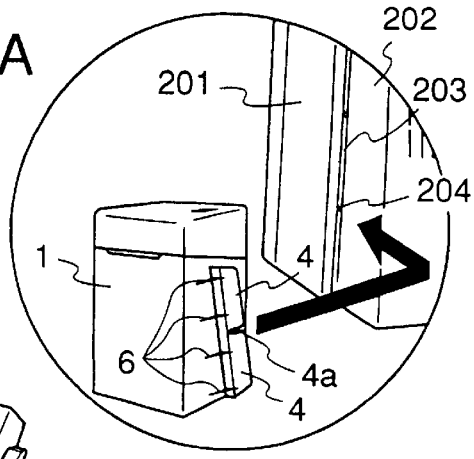
FIGS. 8A to 8C are views illustrating the states of the safekeeping container being mounted on a recording apparatus.

The coupling portion of the front cover 201 and rear cover 202 of the main body of the apparatus has a gap 203 as shown in FIG. 8A. This gap 203 contributes to radiating head generated in the apparatus.

Figure 8B:
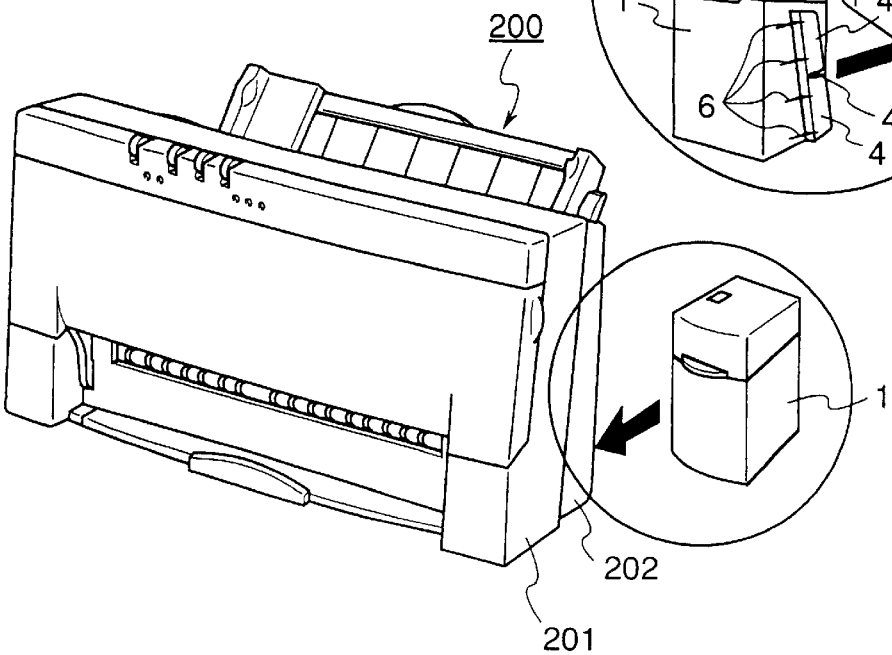

As shown in FIG. 8B, the safekeeping container 1 is attached by inserting the elastic arm 4 for installation arranged on the side end of the safekeeping container 1 into the gap 103 of the recording apparatus 200 in the direction from the rear to the front.

Figure 8C:
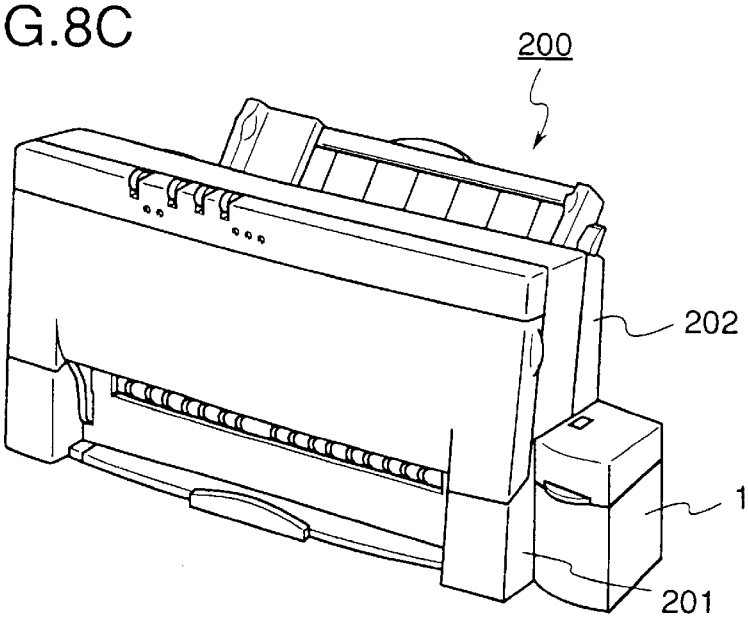

In this respect, a plurality of reinforcing ribs 204 are provided for the coupling portion of the front cover 201 and rear cover 202 for enhancing the strength of the front cover 201 as shown in FIG. 8A. Therefore, the elastic arm 4 for installing the safekeeping container 1 is divided into two parts by a driving portion 4*a* in order to keep away form the reinforcing rib 204 by the divided portion 4*a*. Therefore, it is possible to attach the safekeeping container arbitrarily not only in the lower part of the recording apparatus 200 as shown in FIG. 8C, for instance, but also in the mid part or in the upper part of the recording apparatus 200 by inserting the elastic arm 4 for installation into the gap 203 while placing the reinforcing rib in the mid part or upper part between the divided portion 4*a* of the elastic arm 4 for installation accordingly.

In this respect, the structure whereby to attach the safekeeping container 1 of the present invention to the main body 200 of the recording apparatus can adopt various types such as given below in addition to the one having the elastic arm 4 for installation in a divided mode.

Firstly, an arrangement may be made so that the elastic arm for installation which is formed integrally on the side end of the safekeeping container 1 is prepared as a separate element as shown in FIGS. 9A and 9B, and then, an elastic arm 40 having a section 42 for mounting it on the main body of the recording apparatus and a section 41 for mounting the safekeeping container to it is detach-ably installed on the apparatus as a single body, and that a coupling nail 43 is formed as a separate element on the side end of the safekeeping container 1 for coupling it to the elastic arm 40.

If the coupling nail 43 arranged on the side end of the safekeeping container 1 is provided for each side thereof, the selection of the locations where the safekeeping container 1 is attached to the recording apparatus becomes more flexible because the elastic arm 40 can be attached to either side of the recording apparatus 200.

Here, the installation of the safekeeping container 1 is executed as follows:

At first, as shown in FIG. 9A, the section 42 of the elastic arm 40 for mounting the recording apparatus is inserted for installation into the gap 203 of the coupling portion of the front cover 201 and rear cover 202 of the recording apparatus. Then, as shown in FIG. 9B, the coupling nail 43 provided for the side end of the safekeeping container 1 is inserted from the above into the section 41 for mounting the safekeeping container, thus completing the installation.

Secondly, as another structure whereby to attach the safekeeping container 1, it may be possible to complementarily provide an extrusion and a recess which can engage with each other on the recording apparatus side and the safekeeping container side or thirdly, a structure may be possible by combining a magnet and a metal or fourthly, means for adsorption may be adopted for the purpose.

Also, it may be possible to arrange the elastic elements 10 of the safekeeping container 1 on the bottom of the main body of the container: one is dedicatedly arranged for the ink jet cartridge 107 for monochromatic use while another dedicatedly for the ink jet cartridge 108 for color use. It is preferable to provide the dedicated elastic elements 10 because in this way, the problem of mixing colors can be eliminated more reliably.

However, if only the inner structure of the safekeeping container 1 is arranged as has been described earlier, one elastic element 10 can be shared by the ink jet cartridges for monochromatic use and color use, and it can function effectively for the purpose. In addition, this arrangement can contribute to reducing the number of parts leading to the implementation of the safekeeping container 1 which can be handled more easily at a lower cost. From this point of view, this is more preferable.

Now, when the recording apparatus is not used for a long period of time or it is moved, the safekeeping container 1 attached to the side end of the recording apparatus tends to be a hindrance. Therefore, in such a case, the safekeeping container 1 can be housed in a space S within the scanning range of the carriage C of the recording apparatus 200 as shown in FIG. 10.

The safekeeping container 1 is housed in the space S for the carriage to scan in a state that it is laid down sidelong, but preferably, it should be housed so that the side where the elastic arm 4 for installation is arranged is positioned upward. In this housing mode, the receding head of the ink jet cartridge stored in the safekeeping container 1 is positioned in the lower part, thus allowing ink in the ink tank to pull itself downward by gravity. As a result, ink is refilled in a good condition even if a situation is brought to cause ink to be evaporated from the recording head.

The safekeeping container 1 can be housed at any place in the space S for the carriage to scan, but preferably, it should be positioned to stay away from the flexible cable for transmitting recording signals.

The safekeeping container 1 thus housed is covered by the front lid provided by the front cover 201 of the recording apparatus for covering the recording unit. Therefore, it is in a good housing condition, and presents a desirable mode when it is kept for a long period of time or the recording apparatus should be moved.

As described above, according to the safekeeping container for the ink jet cartridge to which the present invention is applicable, it is possible to cap the recording head appropriately. As a result, the reliability of safekeeping of the ink jet cartridge is high, while the ink jet cartridges for monochromatic use and color use can be stored and safely kept exchangeably.

Also, the safekeeping container can be installed by utilizing the structure in which the recording apparatus is formed. No special structure is required for its installation. Therefore, with a simple structure, it is possible to provide a safekeeping container which can be attached to a recording apparatus reliably and stably.

What is claimed is:

1. A container for safekeeping and storing an ink jet cartridge provided with an ink and an ink tank, said container comprising:

a container member, one side of which is opened, for defining a space capable of storing said ink jet cartridge;

a lid element for covering said open side of said container member, said lid element being openable to open said open side of said container member and closable to cover said open side;

a cap member disposed in said container member, said cap member comprising an elastic material for covering a discharge port surface of said ink jet cartridge;

a substantially rigid engagement member provided on said lid element, said engagement member being engageable with a part of said ink jet cartridge and being capable of pressing the discharge port surface of said ink jet cartridge to said cap member; and a recess provided at a position corresponding to a portion of an inner wall surface of said container member where said cap member is disposed.

2. A container according to claim 1, wherein said elastic cap member is provided with an elastic rib abutting upon a circumference of a surface where discharge ports of said ink jet cartridge are arranged for discharging ink, and said elastic rib is provided with cutoff portions.

3. A container according to claim 1, wherein said ink jet cartridge has either a first mode where said ink jet cartridge comprises a recording head and said ink tank integrally formed together or a second mode where said ink jet cartridge comprises a recording head and said ink tank structured to be attached together or detached apart; said container being configured to store the ink jet cartridges of said first mode and said second mode exchangeably; and at least for the ink jet cartridge of the second mode, a rib of said container presses a frame of said ink jet cartridge for guiding the ink tank.

* * * * *